US005564901A

United States Patent [19]

Moore

[11] Patent Number: 5,564,901

[45] Date of Patent: Oct. 15, 1996

[54] LOW NOISE FAN

[75] Inventor: R. David Moore, Marceline, Mo.

[73] Assignee: The Moore Company, Marceline, Mo.

[21] Appl. No.: 388,180

[22] Filed: Feb. 13, 1995

Related U.S. Application Data

[63] Continuation of Ser. No. 168,631, Dec. 14, 1993, abandoned.

[51] Int. Cl.[6] ..... F04D 29/38; F04D 29/66

[52] U.S. Cl. ..... 416/91; 416/191; 416/231 B; 416/232; 415/220

[58] Field of Search ..... 416/90 R, 91, 416/191, 228, 231 R, 231 B, 232, 233, 229 R, 235, 236 R, 237; 415/173.6, 220

[56] References Cited

U.S. PATENT DOCUMENTS

| | | | |
|---|---|---|---|
| 521,862 | 6/1894 | McConnell et al. | 416/235 |
| 2,013,473 | 9/1935 | Meyer et al. | 416/235 |
| 2,086,307 | 7/1937 | Stewart | 416/237 |
| 2,814,350 | 11/1957 | Nelson | 416/92 |
| 2,918,977 | 12/1959 | Fedan et al. | 416/233 |
| 2,975,962 | 3/1961 | Busquet | 416/90 A |
| 3,647,317 | 3/1972 | Furlong et al. | 416/229 R |
| 4,191,506 | 3/1980 | Packham | 416/91 |
| 4,568,242 | 2/1986 | Susa et al. | 416/237 |
| 4,692,100 | 9/1987 | Nardella | 416/232 |
| 5,282,721 | 2/1994 | Kildea | 416/237 |

FOREIGN PATENT DOCUMENTS

| | | | |
|---|---|---|---|
| 1097285 | 1/1961 | Germany | 416/228 |
| 2405050 | 8/1975 | Germany | 416/191 |
| 1265761 | 3/1972 | United Kingdom | 416/91 |

*Primary Examiner*—James Larson
*Attorney, Agent, or Firm*—Christie, Parker & Hale, LLP

[57] ABSTRACT

A large air moving fan has a number of hollow airfoil blades extending generally radially from a rotatable hub. The tips of the blades are surrounded by a circumferential shroud leaving a narrow gap between the tips of the blades and the shroud. A fin on the tip of each blade extends substantially perpendicular to the transverse cross section of the blade. The outline of the fin corresponds approximately to the shape the airfoil at the tip of the blade and the fin is curved so as to be substantially parallel to the shroud. It is believed that the fin prevents direct radial flow of a boundary layer of air from the outside surface of the blade into the gap between the tip of the blade and the shroud. This reduces the turbulence adjacent to the tip of the blade since the air traveling radially along the blade does not mix as violently with air passing through the gap from the high pressure side of the fan to the low pressure side of the fan. Noise reduction in the order of 3 db is obtained. Further noise reduction is obtained by sealing any gap between the fin and the end of the blade for preventing air leakage adjacent to the fin. A vent, however, is provided for venting air from within the blade to the outside of the blade in a direction substantially along the concave surface of the blade.

13 Claims, 4 Drawing Sheets

LOW NOISE FAN

CROSS-REFERENCE TO RELATED APPLICATION

This is a continuation of application Ser. No. 08/168,631, filed Dec. 14, 1993, abandoned.

BACKGROUND

This invention concerns large air-moving fans rotating in a shroud and provides means for reducing noise level of such fans by several decibels.

Large fans having diameters ranging from about one to seven meters or more are commonly used for moving air through heat exchangers, cooling towers or the like. A typical fan may have a diameter of three meters and from two to eighteen airfoil shaped blades. For light weight and economy, such blades are typically fabricated from thin aluminum alloy sheet. The sheet metal is bent to provide a rounded leading edge, and the rounded upper and lower surfaces of the blade converge toward the trailing edge where they are riveted together. The chord line of the airfoil at the tip of the blade may be in the range of from about 15 to 40 cm. The maximum thickness of the airfoil blade may be in the range of from about 1 to 8 cm.

The blades are typically mounted on a rotatable hub by a clevis. In some manufacturer's fans, the blades are rigidly fixed to the hub in a plane normal to the axis of the fan. In other manufacturer's fans, a resilient member is employed at the mounting so that the blades can "droop" out of such a plane as a result of pressure differences between the two faces of the blade. When the fan is operating, the higher air pressure on the downstream face of the blades tends to force the blades toward the lower pressure face and the blades may droop appreciably away from a plane perpendicular to the axis. In other words, although the blades extend generally radially outwardly from the hub they are not in a plane perpendicular to the axis of the fan. This invention is applicable for either type of fan.

Such large air-moving fans operate within a circumferentially extending shroud. Such shrouds are very often not quite circular and may not be exactly concentric with the axis of the hub. When a fan is installed, the blades and/or shroud are adjusted so that the blades clear the inside of the shroud by one or two millimeters at the closest approach, however, the blades may be 20 to 25 millimeters away from the shroud at the widest gap. Typically, the average gap between the tips of the blades and the shroud is in the order of one centimeter. A small gap is desirable since efficiency decreases as the gap width increases but because of difficulties in maintaining concentricity and a circular shroud, an appreciable average gap is commonly present.

It is generally desirable to operate such fans at relatively high rotation rates to move a large volume of air. However, the noise level from a rapidly rotating large fan may be intolerably high. Noise tends to increase with the fourth power of the rotational velocity. It may therefore be desirable to employ a fan with a relatively larger number of blades so that it can be operated at a lower speed for a given volume of air.

A factor of concern in selecting a fan for a given application is the noise generated by the fan. Blades may be added to the fan so that it can run at lower speed. Noise level also increases with the number of blades, but not at such a rapid rate. However, adding blades also adds cost. Users generally want to rotate a fan at a high velocity to obtain a high airflow. Sound attenuating systems for large fans are quite costly and a low noise fan may avoid need for such systems. Thus, it would be desirable to reduce the noise level from the blades so that a fan could be run at higher rotational speed without objectional noise levels.

It has been found that an appreciable portion of the noise from a large fan is generated as a result of passage of the tip of the blade adjacent to the inside wall of the shroud. The reason for the noise generation in this region is not completely understood, however, certain remedial measures as provided in practice of this invention can reduce the noise level 5 or 6 db. In other words, the noise power may be reduced by a factor of up to four times.

BRIEF SUMMARY OF THE INVENTION

Thus, there is provided in practice of this invention according to a presently preferred embodiment, a fan with a number of airfoil blades extending generally radially from a rotatable hub. A circumferential shroud surrounds the tips of the blades which are spaced a short distance from the shroud, leaving a gap therebetween. A circumferentially extending fin at the tip of each blade is substantially parallel to the shroud. The fin extends perpendicular to the transverse cross section of the blade, typically in the order of from about 10 to 25 millimeters beyond the surface of the blade. It is believed that the tip prevents direct radial flow of a boundary layer from the outside surface of the blade into the gap between the tip of the blade and the shroud.

DRAWINGS

These and other features and advantages of the present invention will be appreciated as the same becomes better understood by reference to the following detailed description when considered in connection with the accompanying drawings wherein.

DESCRIPTION

Figure 1:
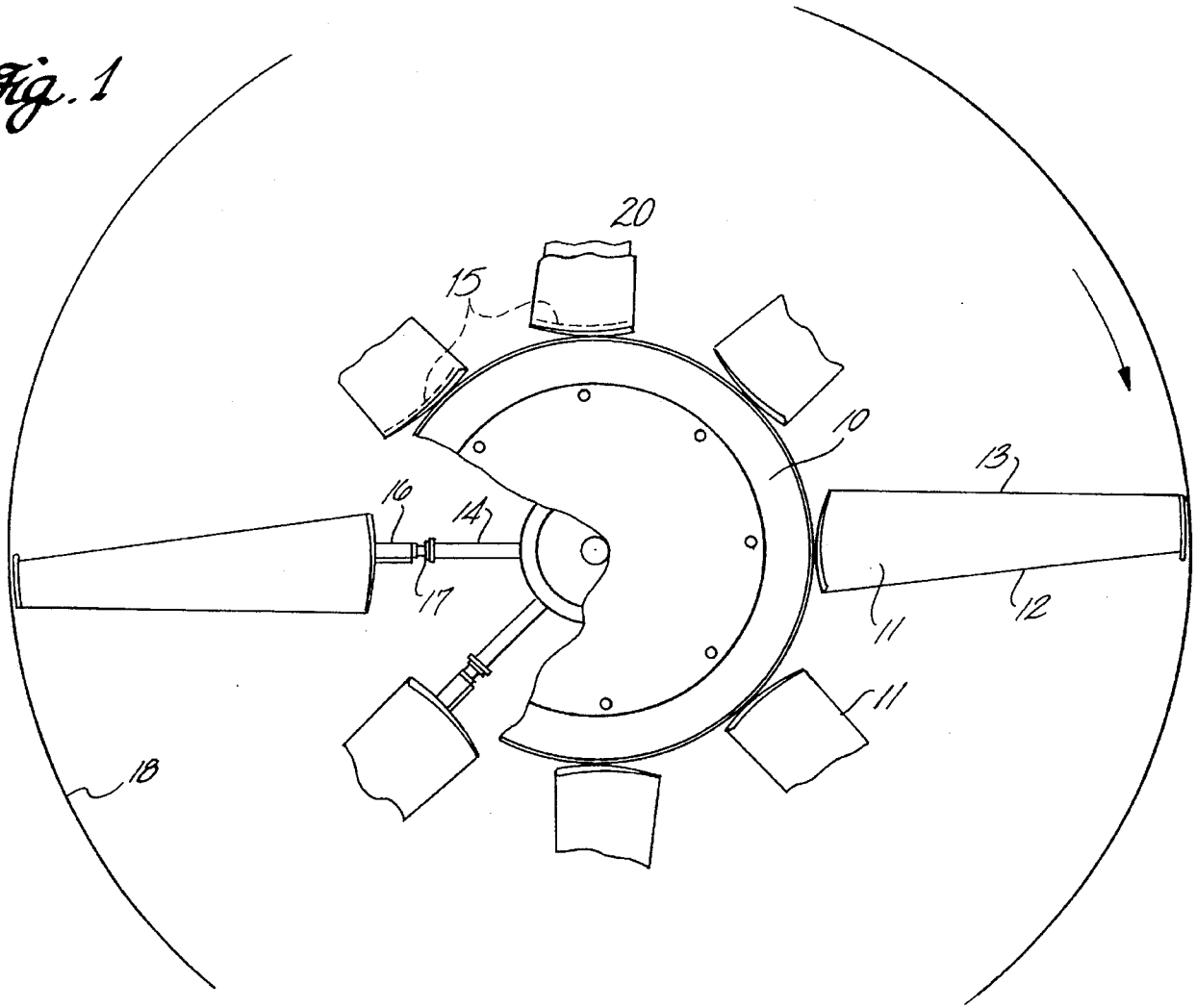
FIG. 1 illustrates in fragmentary plan view, a typical fan constructed according to principles of this invention.

A typical large air volume fan has a rotatable hub 10 which supports eight generally radially extending blades 11. As illustrated in FIG. 1, the fan is blowing upwardly from the plane of the paper and rotates clockwise. A leading edge 12 of each blade is swept back and the trailing edge 13 is approximately parallel to a radius from the axis of the hub.

Each blade is connected to the hub by a radially extending tubular strut 14. The strut is connected to a box section 16 extending inwardly from the blade by a clevis connection 17 which permits adjustment of the radial spacing of the blades from the hub and setting of the pitch or angle of attack of the blade. The interconnection between the blade and hub is conventional and forms no part of this invention, and therefore, is not illustrated in detail.

As has been mentioned, the fan rotates within a circumferentially extending shroud 18 which surrounds the tips of the blades. The blades are adjusted to minimize the width of the gap between the tips of the blades and the shroud. As the fan rotates there is a higher pressure on the downstream face of the blades (above the plane of the paper in FIG. 1) and a lower pressure on the upstream face of the blades (below the plane of the paper in FIG. 1). Because of the pressure difference, air can flow from the high pressure side toward the low pressure side through the gap between the tips of the blades and the shroud. A wide gap represents an inefficiency in the airflow induced by the fan.

A typical blade in such a large fan is fabricated from sheet aluminum with an exemplary wall thickness of about 1.5 mm. The sheet aluminum is bent into an airfoil shape with a generous curvature at the leading edge 12. The edges of the sheet are brought together along the trailing edge 13 and riveted together. The airfoil has a convex low pressure face 19 and a concave high pressure face 21. In a typical fan, the hollow blades are open at their tips and largely open at the inner ends adjacent to the hub.

It is found that an appreciable part of the sound generated in large fans is a consequence of airflow at the tips of the blades. The hollow blades, in, effect act as a centrifugal impeller and induce large airflow through the inside of the blades. Such air discharged into the gap between the tip of the blade and the shroud interacts with the air flowing from the high pressure face of the blade toward the low pressure face of the blade and the resulting turbulence generates appreciable noise. Simply sealing the end of the blade to prevent such air flow through the blade can reduce the noise level in a three meter diameter fan about 2 to 3 db.

Simply sealing the end of the blade is not considered feasible. In most cases the fans operate outdoors and are subjected to rain or snow conditions. Water may enter the inner end of the blade and collect inside a sealed blade. Such water may unbalance the fan and be harmful to its operation. This is a particular problem where water may enter the blade and thereafter freeze. This can occur, for example, when the fan is turned off and the fan can be badly out of balance when it is again started.

Figure 2:
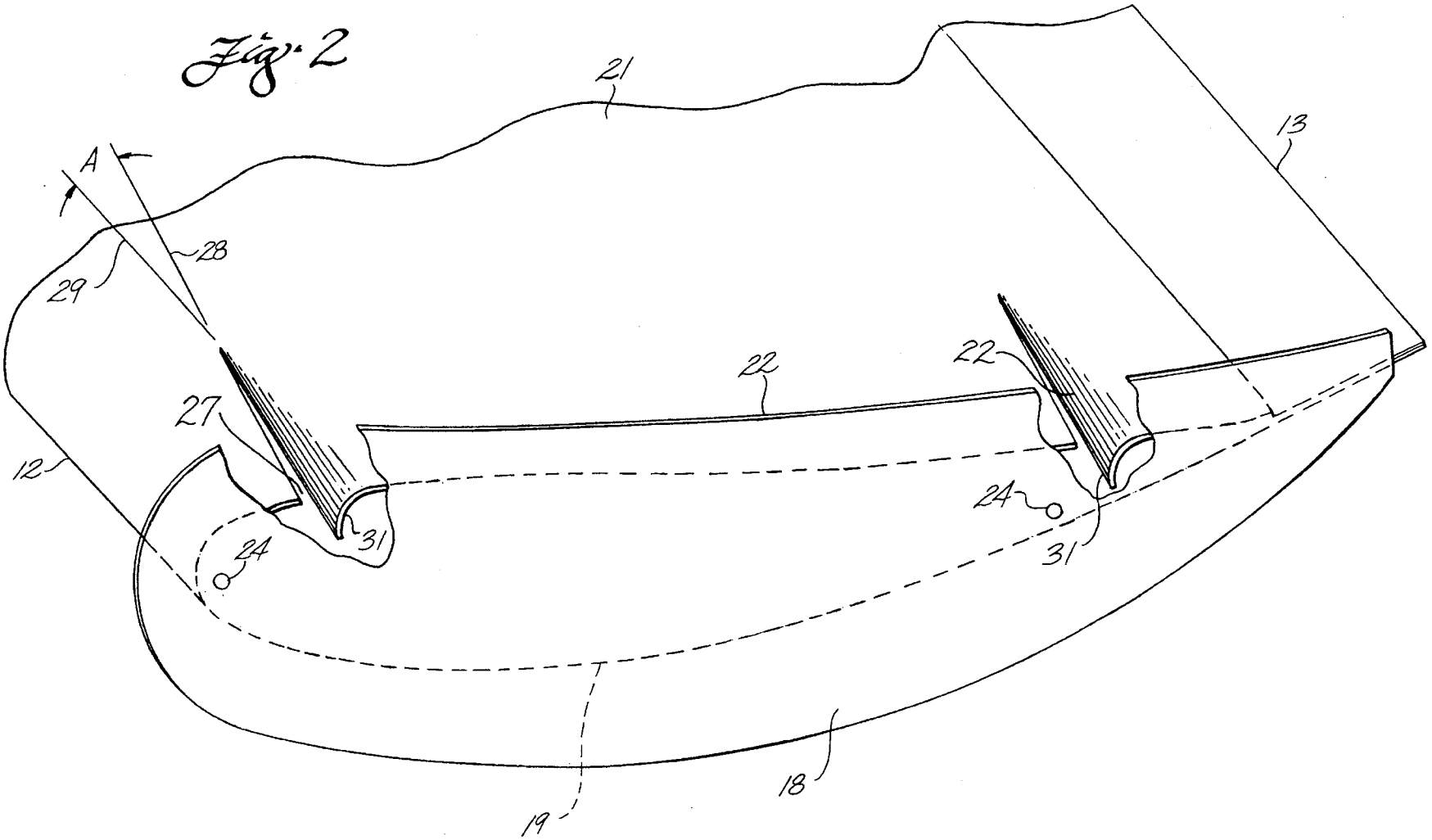
FIG. 2 illustrates isometrically a fin at the tip of a blade on such a fan.
Figure 3:
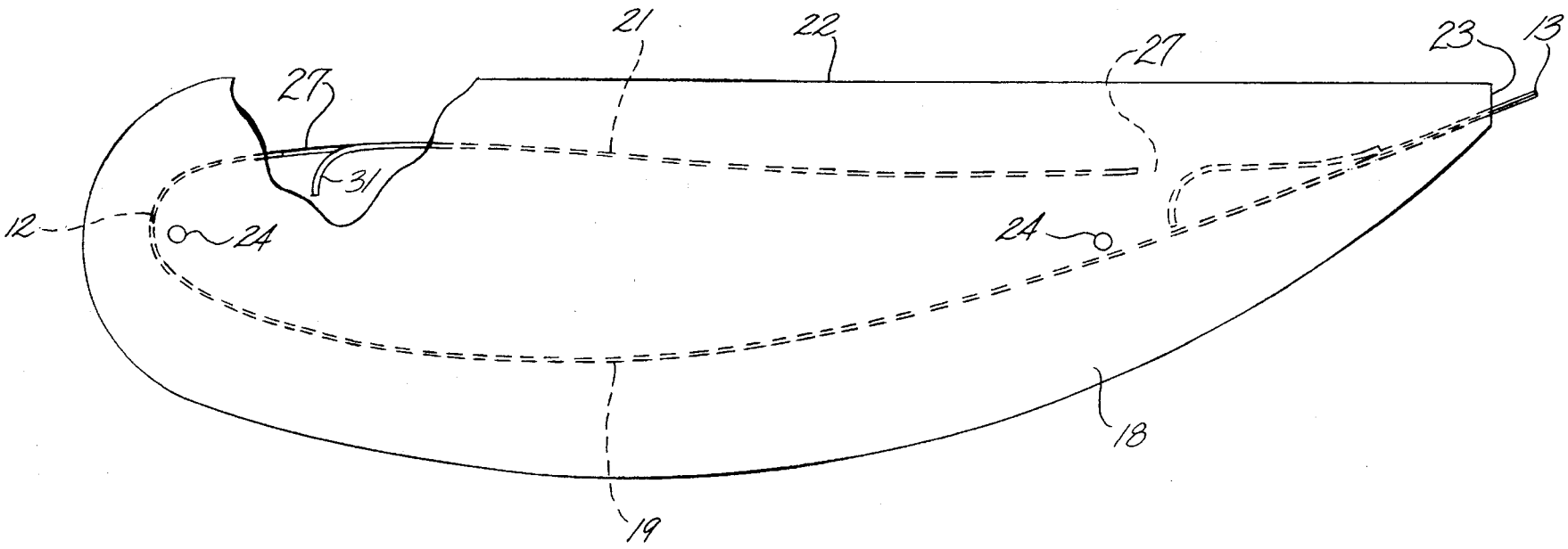
FIG. 3 is an end view of a blade with a portion of the fin cut away for illustrating a vent.

Noise from the tip of the blade can be reduced appreciably, in the order from 2 to 4 db for three meter fan, by addition of a fin 22 to the tip of the blade as illustrated in FIGS. 2 and 3.

The fin comprises a sheet of aluminum having an outline with approximately the same shape as the transverse cross section of the airfoil blade at the tip. In the embodiment illustrated, the downstream edge 23 of the fin is straight instead of being concave like the downstream face 21 of the blade. The trailing end of the fin is also squared off instead of emulating the sharp trailing edge of the blade. The fin is secured to the skin of the blade by small L-shaped brackets (not illustrated) riveted inside the hollow blade. The fin is secured to the L-shaped brackets by rivets 24.

The fin is not planar as might appear from the illustration of FIG. 3, but instead has a curvature parallel to the curvature of the shroud. Thus, there is essentially a uniform gap between all portions of the fin and the shroud. The fin is approximately perpendicular to the outer surface of the blade, although in a fan where the blade is designed to droop relative to a plane normal to the axis of the fan, the end of the blade may not be exactly perpendicular to the principal length of the blade so that there is a uniform width of gap between the end of the drooping blade and the surrounding shroud. A typical angle of droop is in the order of 8° on a large fan and the fin on such a blade may be within about 8° of normal to the surface of the blade. The amount of drooping depends on the size of the fan, smaller fans having little or no drooping.

In an exemplary embodiment, the tip of the blade is cut normal to the length of the blade and the fin is substantially perpendicular to the surface of the blade. The edge of the fin on the concave side of the blade is made straight instead of matching the curve of the airfoil so that the gap between the tip and shroud has substantially constant width between the leading and trailing edges regardless of droop of the blade.

The edge of the fin extends beyond the transverse cross section of the blade a distance in the order of one to four centimeters. In an exemplary embodiment with the blade having a 32 centimeter chord, the fin has a width ranging from about 15 to 30 millimeters beyond the skin of the blade.

Figure 4:
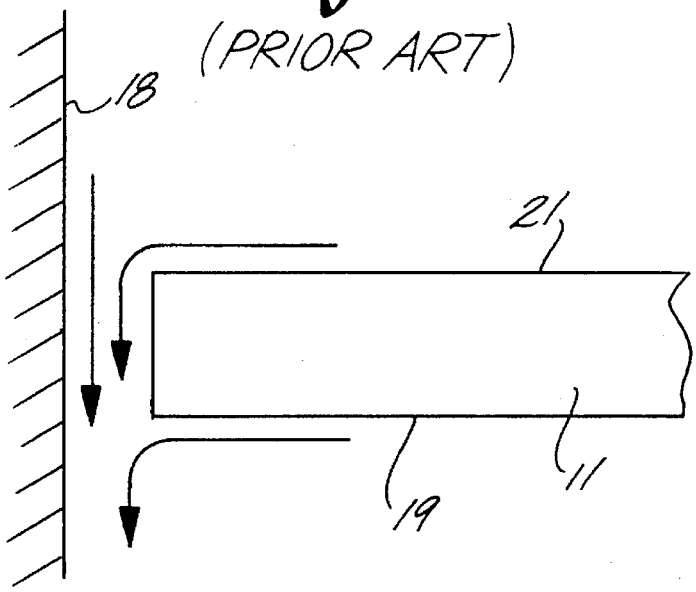
Fig. 4 (PRIOR ART)
FIG. 4 illustrates schematically what is believed to be airflow at the tip of a blade in the absence of a fin.
Figure 5:
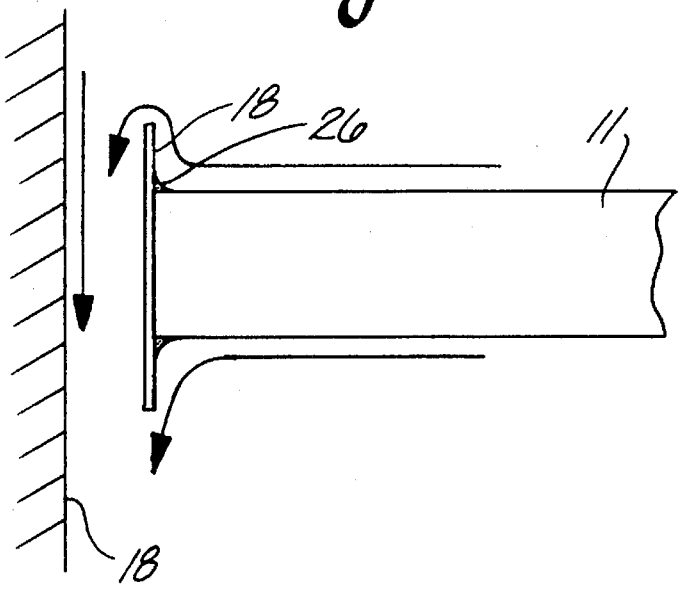
FIG. 5 illustrates schematically airflow at the tip of a blade with a fin.

The reason that the fin is effective in reducing the noise generated at the tip of the blade is not completely understood. There is evidence that there is a substantial radial flow of air in a boundary layer on the surface of the blade. Thus, there is a boundary layer of air moving along the length of the blade toward the shroud. FIGS. 4 and 5 schematically illustrate the end of a blade 11 adjacent to a shroud 18. Each of these illustrations is in a circumferential direction looking into the leading edge of a blade. The higher pressure concave face of the blade is at the top and the lower pressure face is at the bottom. The usual airflow from the higher pressure to lower pressure areas is illustrated as a vertical arrow.

It is believed that a boundary layer of air moves along each face of the blade toward the shroud. As a boundary layer bleeds off the end of the blade, it intersects air flowing through the gap, as illustrated in FIG. 4, at substantially a right angle and with substantial velocity. The resultant turbulence generates noise. On the other hand, when there is a fin 22 on the tip of the blade, the radial flow of the boundary layer is prevented from directly flowing into the gap between the fin and shroud. Instead of flowing directly radially into the air leaking through the gap, the boundary layer is deflected outwardly so that at least some of its energy is dissipated. Although, the boundary layer probably retains sufficient radial velocity to mix with the air flowing through the gap, it should encounter that air with a lower velocity vector difference.

Regardless of the mechanism for noise reduction, in a three meter diameter fan, addition of a fin may reduce the noise level about 3 db. In other words, the noise power is about one half the noise power of a hollow blade with an open end.

It had already been discovered that a closed end on a blade (without a fin) for a three meter fan reduces noise level about 2.5 to 3.5 db. The fin alone riveted to the tip of the blade effected about the same amount of noise reduction. It was then discovered that an additional noise reduction can be achieved by carefully sealing the narrow gap between the tip of the blade and the fin. Although the fin is pulled against the end of the airfoil cross section when riveted, air pressure within the rotating blade and centrifugal forces apparently cause the narrow gap to open and permit appreciable air leakage through this gap, which violently mixes with the boundary layer and induces appreciable noise. A thin bead of silicone sealant 26 applied along the interface between the tip of the blade and the fin seals this gap and, surprisingly, reduces the noise an additional 2.5 to 3 db.

For example, in a one meter diameter fan, sealing the tip of the blade reduced noise from 66.6 dbA to 60.7 dbA. Simply adding a fin as described above reduced noise to 60.2 dbA. Sealing the narrow space between the tip of the blade and the fin with a silicone sealant reduced noise to only 54.2 dbA.

Although sealing the narrow gap between the tip of the blade and the fin reduces noise, it blocks the venting of high pressure air from within the hollow blade. Thus, water or ice can build up within the blade. Means are therefore provided for venting air from within the blade to the outside. Preferably, the inside air is vented toward the concave or higher pressure face of the airfoil. Noise generated by venting air is minimized when the velocity difference between the vented air and outside air is minimized. The velocity difference between ram air from within the blade and air flow along the airfoil is minimized on the high pressure face of the blade. It is also preferred that the air from within the blade be vented in a direction substantially along the surface of the blade so that there is a minimum of induced turbulence.

Two vent openings 27 are made near the tip of the blade on the concave higher pressure face. The vent openings are substantially similar and only one is described. A diagonal slit is made in the sheet aluminum along a line 28. The slit is at an angle A of about 30° from a line 29 parallel to the leading edge of the blade. The forward part of the slit is nearest the tip of the blade. That is, the inner end of the slit is closer to the trailing edge of the blade than is the outer end of the slit. The length of the slit is about 25 to 30 millimeters.

A small triangle of metal aft of the slit is curled inwardly into the inside of the blade to form an opening through the skin of the blade. In effect, the curl 31 is approximately ¼ of the surface of a cone with an edge of the conical surface being tangent to the outside surface of the blade aft of the curl. The base of the conical segment is adjacent to the fin and the point of the cone is adjacent to the inner end of the slit.

It is believed that air venting from within the hollow blade is guided along the smoothly curling outside surface of the curl by the coanda effect so that it enters the stream of air along the concave face of the airfoil in a direction more or less along the surface of the airfoil and toward the trailing edge. Such venting minimizes turbulence from vented air and thereby minimizes noise. The volume of air flowing through the vents may be minimized for minimizing noise by largely closing the inner end of the blade, thereby blocking air from entering the blade.

Other means may be used for preventing air leakage from inside the blade between the tip of the blade and the fin. Although the means for doing so can be complex, the inner end of the blade may be sealed for largely preventing air from entering the blade. In other words, the hollow blade can be "plugged" at either end either by a fin at the outer end or a plug 15 near the inner end. Another way of preventing air leakage from inside the blade is to fill the blade with polyurethane foam such as illustrated by foam 20 in one of the blades 11 in FIG. 1. It is found that foam filling a blade can reduce the noise about 6 db. This may not be a satisfactory solution since the foam can absorb water if it is open cell foam. The foam may have too much thermal expansion if it is closed cell foam.

Although limited embodiments of low noise fan have been described and illustrated herein, it will be apparent to those skilled in the art that there are substantial variations that may be made within the scope of this invention. Thus, for example, the fin at the end of the blade may be largely on the concave or higher pressure face of the airfoil blade where it is believed that a principal portion of the noise is generated. Instead of simply being parallel to the inside of the shroud, the fin may have a different curvature from the shroud so that aerodynamic effects minimize airflow through the gap.

The fin may be formed somewhat like a "curved delta wing" where the edge of the fin is essentially flush with the leading edge of the airfoil at the neutral pressure point and gradually flares toward greater distances from the curved surface of the airfoil as the edge of the fin recedes from the neutral pressure point. Such a delta wing configuration is particularly useful on the higher velocity or lower pressure face of the airfoil. A fin with such a shape may pick up air coming through gap between the fin and shroud and deflect it away from the wall of shroud. This reduction of high velocity flow of air through the gap and along the wall of the shroud may avoid disturbing inlet air flow as it enters the shroud and thereby improve fan performance.

Other arrangements for venting ram pressure air from within the hollow blade may also be employed, although care must be taken to avoid vents that nullify the noise reduction achieved by sealing the gap between the tip of the blade and the fin.

The invention has been described in the context of a hollow blade. It should be apparent that a fin may also be applied to the end of a solid blade rotating within a shroud. A fin may also be useful on a "single thickness" blade; that is, a blade which is stamped from a sheet of metal with camber, but without any thickness greater than the thickness of the metal sheet. Many smaller fans with such sheet metal blades operate with high rotation speeds and produce a substantial proportion of their noise at the blade tips. Addition of a fin transverse to the length of the blade and parallel to the shroud can cut the tip noise appreciably.

Because of such variations, it is to be understood that within the scope of the appended claims, this invention may be practiced otherwise than as specifically described.

What is claimed is:

1. A fan comprising:

a rotatable hub;

a plurality of hollow airfoil blades extending generally radially from the hub to an outer tip for accelerating air passing through the fan;

a circumferential shroud surrounding the tips of the blades;

a circumferentially extending fin at the tip of each blade spaced apart from and substantially parallel to the shroud, the fin extending outwardly from the transverse cross section of the blade; and means for substantially preventing air leakage from inside the blade between the tip of the blade and the fin.

2. A fan as recited in claim 1 further comprising means near the tip of the blade for venting air from within the blade to the outside of the blade on the higher pressure face of the blade in a direction substantially along the surface of the blade.

3. A fan as recited in claim 2 wherein the means for venting air from within the blade comprises an opening through the surface of the blade and a surface adjacent to the opening curling smoothly from within the blade and tangent to the outside surface of the blade aft of the curl.

4. A fan as recited in claim 1 wherein the fin extends approximately perpendicular to the surface of the blade a distance in the range of from about 1 to 4 centimeters from the outside surface of the blade.

5. A fan as recited in claim 1 wherein the fin extends approximately perpendicular to the surface of the blade a distance in the range of from about 1 to 4 centimeters from the outside surface of the blade.

6. A fan comprising:

a rotatable hub;

a plurality of hollow airfoil blades extending generally radially from the hub to an outer tip for accelerating air passing through the fan;

a circumferential shroud surrounding the tips of the blades leaving a gap between the tips of the blades and the shroud;

a sheet-like fin at the tip of each blade extending approximately perpendicular to the outside surface of the blade around substantially the entire transverse cross section of the blade and approximately parallel to the shroud for substantially preventing direct radial flow of a boundary layer from the outside surface of the blade into the gap between the tip of the blade and the shroud; and a sealant between the fin and the hollow interior of the blade.

7. A fan as recited in claim 6 wherein the fin for preventing radial flow is on the higher pressure face of the blade.

8. A fan as recited in claim 6 wherein the fin for preventing radial flow extends away from the outside surface of the blade a distance in the range of from about 1 to 4 centimeters.

9. A fan as recited in claim 6 further comprising means near the tip of the blade for venting air from within the blade to the outside of the blade on the higher pressure face of the blade.

10. A fan comprising:

a rotatable hub;

a plurality of hollow airfoil blades extending generally radially from the hub to an outer tip for accelerating air passing through the fan;

a circumferential shroud surrounding the tips of the blades leaving a gap between the tips of the blades and the shroud; and means near the tip of the blade for venting air from within the blade to the outside of the blade on the higher pressure face of the blade in a direction substantially along the surface of the blade from a leading edge toward the trailing edge.

11. A fan comprising:

a rotatable hub;

a plurality of airfoil blades extending generally radially from the hub to an outer tip for accelerating air through the fan;

a circumferential shroud surrounding the tips of the blades;

a circumferentially extending fin at the tip of each blade on at least the higher pressure face of the blade spaced apart from and substantially parallel to the shroud;

a vent adjacent the tip of the blade on the higher pressure face of the airfoil; and means for guiding airflow from within the blade in a direction along the outside surface of the blade.

12. A fan as recited in claim 11 wherein the vent comprises an opening through the surface of the blade and a surface adjacent to the opening curling from within the blade and tangent to the outside surface of the blade aft of the curl.

13. A fan as recited in claim 11 wherein the fin extends outwardly from the transverse cross section of the blade at the tip for substantially preventing direct radial flow of a boundary layer from an outside surface of the blade into a gap between the tip of the blade and the shroud.

* * * * *